US006784388B1

(12) United States Patent
Braaten

(10) Patent No.: US 6,784,388 B1
(45) Date of Patent: Aug. 31, 2004

(54) FOOT OPERATED ELECTRICAL CONTROL

(76) Inventor: Ronald J. Braaten, 85 Braaton Hill Rd., Woodstock, CT (US) 06281

( * ) Notice: Subject to any disclaimer, the term of this patent is extended or adjusted under 35 U.S.C. 154(b) by 0 days.

(21) Appl. No.: 09/710,554

(22) Filed: Nov. 11, 2000

(51) Int. Cl.[7] ..... H01H 3/14

(52) U.S. Cl. ..... 200/86.5; 200/335; 74/108; 74/512; 74/514; 338/153

(58) Field of Search ..... 200/86.5, 335, 200/343; 338/153, 197; 74/512–14, 10.7, 523, 548, 560, 561, 108; 403/346, 400

(56) References Cited

U.S. PATENT DOCUMENTS 2,681,586 A * 6/1954 Pressler ..... 338/153 X
3,353,424 A * 11/1967 Peterson et al. ..... 200/86.5
3,480,752 A * 11/1969 Cherry et al. ..... 200/335
4,006,441 A * 2/1977 Godrich ..... 338/153
5,165,531 A * 11/1992 Kawakami et al. ..... 200/335 X
5,535,642 A 7/1996 Moll ..... 74/561

* cited by examiner

*Primary Examiner*—Renee Luebke
(74) *Attorney, Agent, or Firm*—Cantor Colburn LLP

(57) ABSTRACT

Apparatus for foot operating an electrical element having a rotatable operating shaft comprising a base member adapted to be secured to a floor and defining a top opening cavity, a shaft rotatably mounted in opposite side walls of the base member, a treadle member mounted to the shaft and arranged to rotate the shaft when depressed by foot pressure, a support member secured to the base member in the cavity and having at least one upstanding wall, an electrical element having a rotatable operating shaft mounted to at least one upstanding wall, an operating arm mounted at one end thereof to said shaft and extending to a free end thereof toward said electrical element operating shaft, said free end including a surface, a flexible cord connected at one end thereof to said operating arm toward the end of said of said operating arm mounted to said shaft, extending over said surface, spirally wrapped a plurality of times about said electrical element shaft and anchored at its other end to a point on the base member.

13 Claims, 4 Drawing Sheets

10
11
12
12a
12b
13
13b
13c
15
15a
19
20
21
22
24
25
26
27
36
37a
37b
58
59
60
64
65
66
67
68
S
H

FOOT OPERATED ELECTRICAL CONTROL

FIELD OF THE INVENTION

This invention relates to foot operated electrical controls and more particularly relates to a foot operated mechanism which may determine the angular position of the shaft of a potentiometer or other rotatable control device as well as the operation of switches.

BACKGROUND OF THE INVENTION

Mechanisms for controlling the operation of foot operated switches and potentiometers which vary resistance by rotation of a shaft are well known. A commonly used mechanism is one in which a potentiometer has a pinion mounted to its shaft and the pinion is engaged by a gear segment or arm which upon pivotal movement rotates the shaft mounted pinion. Such an arrangement is exemplified in U.S. Pat. No. 5,535,642. This arrangement requires the provision of and mounting of a pinion to the potentiometer shaft and further the definition of a segment of a gear on the pivotal operating arm. While this mechanism has found widespread use, it has an operating drawback in that the meshing teeth of the gear and pinion may not provide smooth operation because of the increments of rotation defined by the teeth and also backlash in the teeth.

Another somewhat similar arrangement has been to place a wheel on the shaft of a potentiometer, which is engaged by an arcuate surface or end of a pivotal operating arm. This arrangement is rather expensive in requiring tight tolerances and additionally a force to hold the roller and arcuate surface or end of operating arm in contact. A further factor, which must be considered, is the play or sloppiness in the bearing for the potentiometer shaft. These considerations make the latter mentioned construction rather expensive.

Accordingly, the present invention provides a new and improved operating mechanism for a potentiometer mounted for foot operation which is smooth and accurate in operation and which is of reduced construction cost.

An object of this invention is to provide a new and improved foot operated mechanism for producing rotary motion of the shaft of an electrical element.

Another object of this invention is to provide a new and improved mechanism for controlling the angular position of a rotatable shaft, which is simple in construction and economical in cost.

A further object of this invention is to provide a new and improved foot operated mechanism of simplified design and economical cost for producing rotation of the shaft of an electrical element such as a potentiometer.

A still further object of this invention is to provide a new and improved pivotal connection between the base and treadle members of a foot operated electrical control.

SUMMARY OF THE INVENTION

Briefly stated, the invention, in one form thereof, comprises apparatus for foot operating an electrical element having a rotatable shaft comprising a base member adapted to be secured to a floor and defining a top opening cavity. A shaft is journaled in opposite side walls of the base member for rotation or pivotal motion therein and a treadle member is mounted to said shaft and arranged to rotate the shaft when depressed by foot pressure. A support member is secured to the base member within the cavity and has at least one upstanding wall. An electrical element such as a potentiometer having a rotatable operating shaft is mounted to the at least one upstanding wall. An operating arm is mounted at one end thereof to said shaft and has a bent over free end defining an elongated arcuate surface adjacent the operating shaft. A flexible cord is connected at one end thereof to the operating arm at a location toward the mounting of the operating arm to the shaft. The cord extends over a portion of the arcuate surface, is spirally wound a plurality of times about the operating shaft, continues over said surface and is anchored at its other end to said operating arm. The cord is of a fixed length. Upon depression of the treadle and rotation of the shaft, the cord moves along the elongated surface surface, while frictionally engaging the operating shaft, and rotates the shaft in accordance with the amount of depression of the treadle member.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DETAILED DESCRIPTION OF PREFFERED EMBODIMENTS OF INVENTION

Figures 1, 5A, 5B:
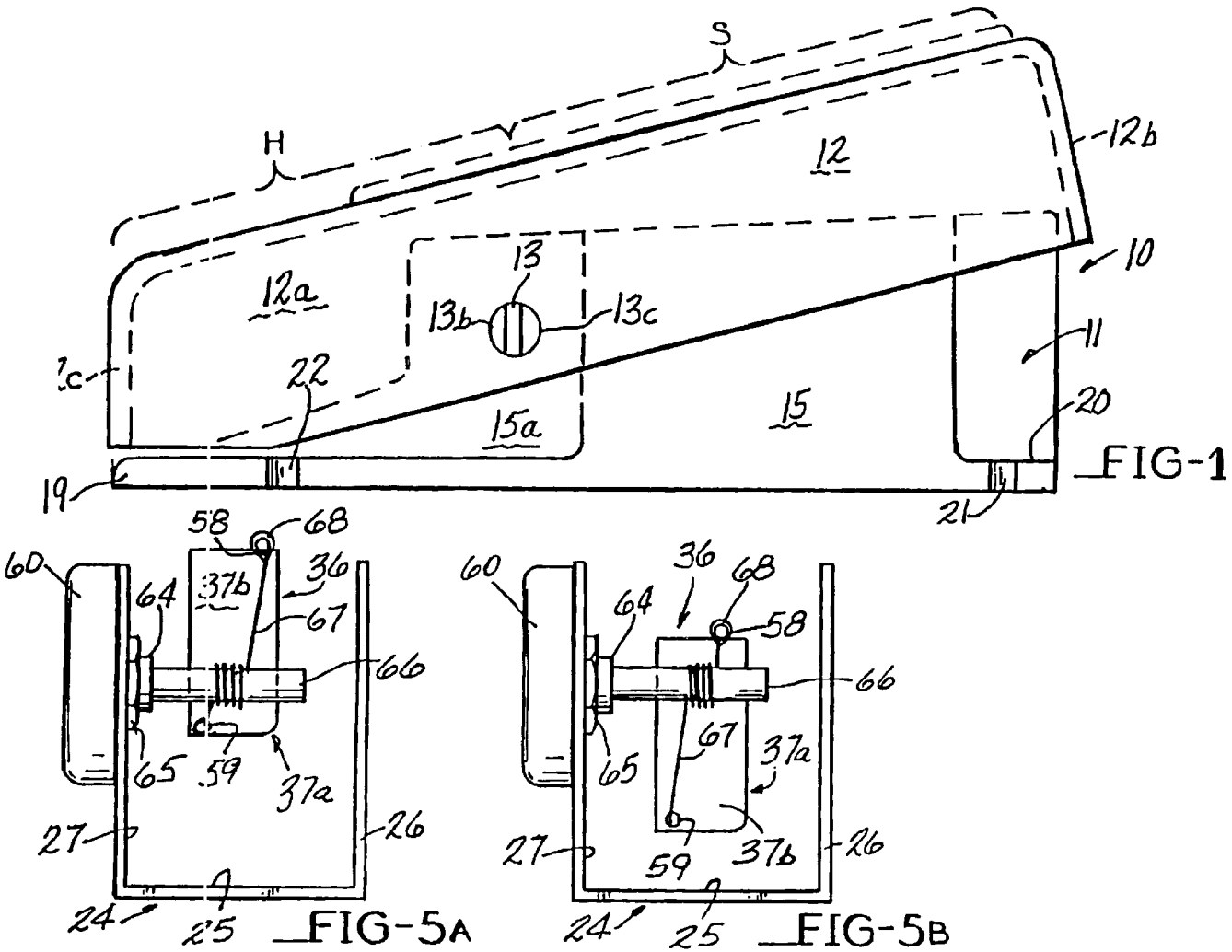
FIG. 1 is a side elevation of apparatus embodying the invention showing a base member and a foot operated treadle member pivotally mounted to the base member.
FIGS. 5*a* and 5*b* are views of the support member of FIG. 3 and the operating arm of FIG. 4 seen in the plane of lines 5—5 of FIG. 2.
Figure 2:
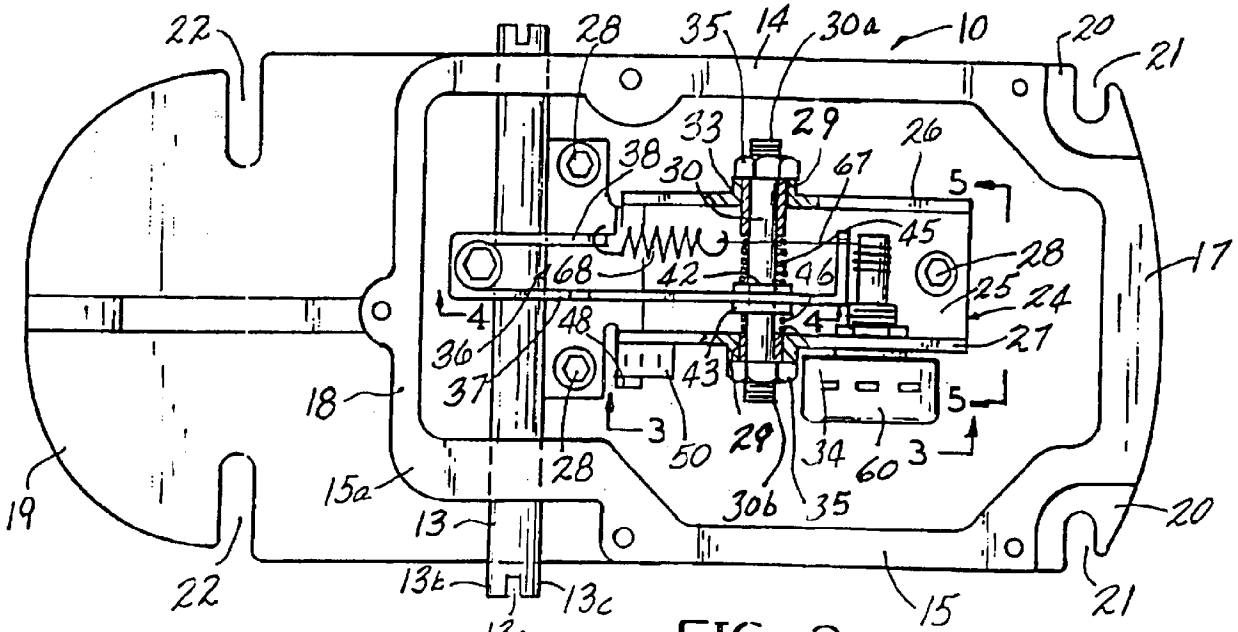
FIG. 2 is a plan view of the apparatus of FIG. 1 with the treadle member removed.

Reference is initially made to FIGS. 1 and 2, which illustrate apparatus 10 embodying the invention. A base member 11 has a foot actuated treadle member 12 connected thereto by means of a shaft 13 which is rotatable in base member 11. One end of shaft 13 is formed with a slot 13*a* to define projections 13*b* and 13*c* (FIG. 2) which are received in mating slots in side wall 12*a* of treadle member 12. Thus shaft 13 will rotate with pivotal movement of treadle member 12.

Shaft 13 is between what may be termed a sole portion S and a heel portion H of the top wall of treadle member 12. As will hereinafter be explained treadle member 12 may be depressed by foot pressure on portion S and be held in a given position until returned by pressure on heel portion H, or it may be returned to the position shown in FIG. 1 by the action of a spring. Treadle member 12 further includes side walls 12*a* spanning the upstanding side walls of base member 11, and end walls 12*b* and 12*c*.

As seen most clearly in FIG. 2, base member 11 includes upstanding side walls 14 and 15. Side wall 15 includes an offset portion 15*a*. The side walls are joined by end walls 17 and 18. Base member 11 further includes a lower bottom flange 19 and two corner flanges 20. Slots 21 are defined in flanges 20 to receive hold down or securing screws or bolts. Slots 22 are defined in opposite sides of flange 19 for the same purpose.

Shaft 13 is journaled in side walls 14 and 15*a* and is fixed to the treadle member, as hereinafter described, and will rotate when treadle member 12 is depressed. A support member 24 having a base portion 25 joining spaced apart upstanding side walls 26 and 27 is secured to base member 11 as by a plurality of screws 28. Support member 24 may be a stamping with the side walls 26 and 27 later bent upwardly. A circular aperture is defined in each of side walls 26 and 27 and each has outwardly protruding bosses 29 defined thereabout. A shaft 30 having threaded ends 30*a* and 30*b* extends through the apertures in side walls 26 and 27. A sleeve 33 is disposed around shaft 30 within boss 29 in side wall 26 and a sleeve 34 is disposed about shaft 29 within boss 29 in side wall 27. A nut 35 is threaded on each end of shaft 30. Nuts 35 will abut the edges of bosses 29 and prevent outward movement of sleeves 33 and 34.

Figure 4:
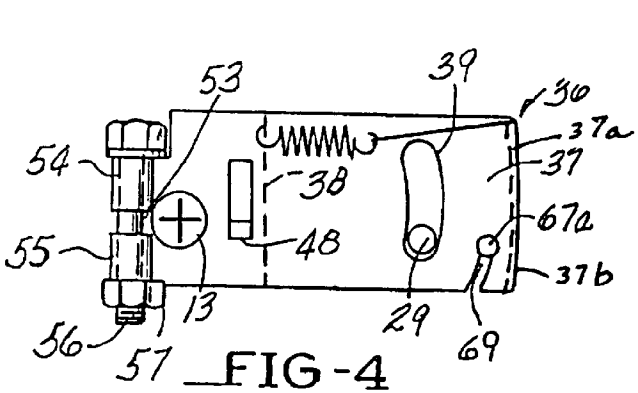
FIG. 4 is a side elevation of an operating arm seen in the plane of lines 4—4 of FIG. 2.

Mounted within side walls 26 and 27 of support member 24 is an operating arm 36 having a long leg 37 and a short leg 38. As shown in FIG. 4, long leg 37 has an arcuate slot 39 defined therein which receives shaft 29 therethrough. This arrangement permits the operating arm to rotate a limited distance with shaft 13 and move with respect to support member 24.

Two friction pads or disks 42 and 43 are disposed about shaft 30 in contact with long leg 37 of operating arm 36. Disposed about shaft 36 between an end of sleeve 33 and friction disk 42 is a compression spring 45. Disposed about shaft 30 and an end of sleeve 34 is a compression spring 46. Compression springs 45 and 46 urge the friction disks 42 and 43, respectively, into contact with opposite sides of long leg 37 of arm 36. This arrangement of friction disks 42 and 43 biased by springs 45 and 46, respectively provide a friction clutch or brake which will hold operating arm 36 in a predetermined position, as will be hereinafter more fully discussed.

The long leg 37 of operating arm 36 has a finger 48 (FIG. 3) struck therefrom and extending substantially perpendicular to leg 37. Finger 48 extends into a generally rectangular notch 49 defined in side wall 27 of support member 24. Secured to side wall 27 above and below notch 49 are switches 50 and 51 having operating buttons or arms 50*a* and 51*a*, respectively. Finger 48 is arranged to close and/or open either or both of switches 50 and 51, dependent on the circuit design the invention is to be used with. It is to be understood that the use of one or both of switches 50 and 51 is an option.

Operating arm 36 is fast on shaft 13. As shown in FIGS. 4 and also partially in FIG. 1, a split opening 53 is formed in the legs of operating arm 36. The joined ends of the legs 37 and 38 are formed to define sleeve portions 54 and 55. A headed bolt 56 extends through sleeve portions 54 and 55 and receives a nut 57 on the end thereof. This clamps the edges defining openings 53 about shaft 13 so that operating arm 36 will rotate with shaft 13.

Reference is now made to FIGS. 5*a* and 5*b* taken in conjunction with FIGS. 2 and 4. FIGS. 5*a* and 5*b* show operating arm 36 in different positions with respect to support bracket 24.

As shown in FIGS. 5*a* and 5*b*, long leg 37 of operating arm 36 has a plate 37*a* bent substantially perpendicular therefrom which provides an elongated end surface 37*b*. Surface 37*b* is formed on an arc having a radius essentially the distance to the centerline of shaft 13 (see FIG. 4). Plate 37*a* at its upper and lower edges has a notch forming an upper guide way 58 and an aperture forming a lower guide way 59 which receives cord 67 therethrough as hereinafter pointed out.

An electrical element, shown as a potentiometer 60, is secured to side wall 27 of support member 24. Potentiometer has the usual terminal connections 61–63 (shown in FIG. 3 only) and a threaded stud 64 extending therefrom and through an opening in side wall 27. A nut 65 is received on stud 64 to clamp potentiometer 60 to side wall 27. A rotatable shaft 66 extends coaxial through stud 64.

Shaft 66 moves the wiper contact of potentiometer over the range of the potentiometer resistance and typically will rotate through about 310 degrees.

A cord 67 is utilized to rotate shaft 66. Cord 67 has a first end attached to a spring 68 (FIG. 2) which is attached to short leg 38 of operating arm 36. Cord 67 extends from spring 68 through guide way 58 (FIGS. 5*a* and 5*b*) over surface 37*a*, is spirally wrapped around shaft 66 a predetermined number of times, continues through guide way 59 and is anchored at its other end in a slot or aperture 69 defined in leg 37 of operating arm 36 as by forming a knot 67*a* in the end. Alternatively, a knot 67*a* in the end of cord 67 may be located on the other side of surface 37*b*, as viewed in FIGS. 5A and 5B, to anchor that end of cord 67. Spring 68 serves to tension cord 67 and maintain tension therein as it may stretch with use over time.

The number of wraps of cord 67 about shaft 66 is chosen to provide sufficient frictional engagement of the wraps of cord about shaft 66 to uniformly rotate potentiometer shaft 66 as a function of angular movement of operating arm 36. Cord 67 is of a fixed overall length.

As the ends of end 37*a* of leg 37 moves downwardly with foot pressure on the sole portion of S of treadle member 12 from the position shown in FIG. 5A to the position shown in FIG. 5B, leg 37 exerts a downward pull on cord 67. This downward pull is exerted either by an edge defining guide way 59 or by a knot 67*a* tied behind guide way 67*a*59. This motion of end 37*a* of leg 37 produces travel of the turns of cord 67 about shaft 66 and resultant smooth, non-incremental rotation of shaft 66.

As the end 37*a* of leg 37 moves upwardly from the position shown in FIG. 5B to the position shown in FIG. 5A, the edges defining guide way 58 exert an upward pull on cord 67 and produce travel of the turns of cord 67 on shaft 66 and resultant smooth rotation of shaft 66.

Cord 67 is of a fixed, predetermined length. The movement of the cord in rotating shaft 66 is exemplified by the difference in dimension of end plate 37*b* above and below shaft 66 as seen in FIGS. 5A and 5B.

As thus far described, the frictional engagement of pads 42 and 43 on leg 37 of operating arm 36 will hold arm 36 in a set position.

Another embodiment of the invention is shown in FIGS. 6–9. The embodiment of FIGS. 6–9 is similar to that shown in FIGS. 1–5. The primary difference being the connection of the treadle member to the shaft, and the shaft 30 as shown in FIG. 2 is not used. Similar elements of FIGS. 6–9 to those of FIGS. 1–5 are identified by the same reference numerals advanced by one hundred.

The embodiment 110 of FIGS. 6–9 comprises a base member 111 having a foot actuated treadle member 112 pivotally connected thereto by means of a shaft 113. The connection of shaft 113 to treadle member 112 is hereinafter described. Treadle member 112 further includes end walls 112*c* and 112*d*.

Figure 7:
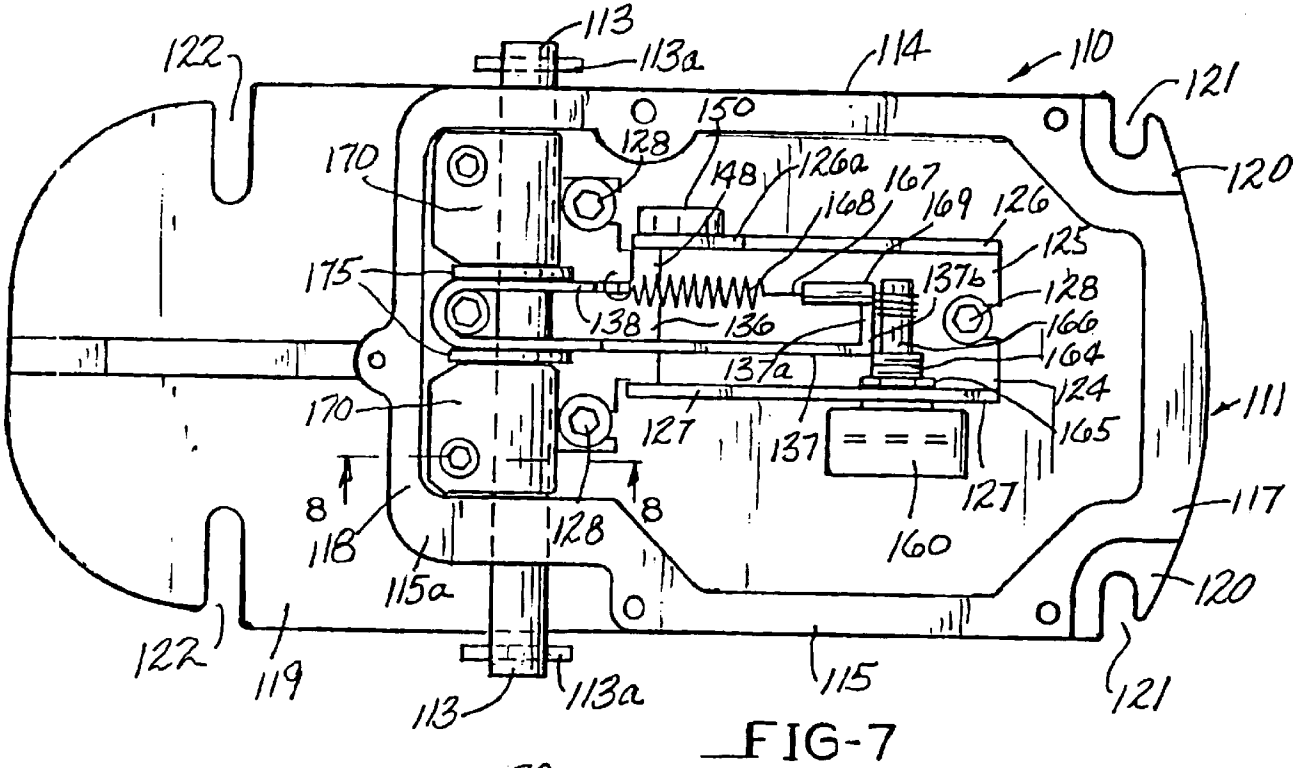
FIG. 7 is plan view of the device of FIG. 6, with the treadle member removed.

As seen most clearly in FIG. 7, base member 111 includes upstanding side walls 114 and 115. Side wall 115 includes an off set portion 115*a*. The side walls are joined by end walls 117 and 118. Base member 111 further includes a lower bottom flange 119 and two corner flanges 120. Slots 121 are defined in flanges, 120 to receive hold down or securing screws or bolts. Slots 122 are defined in opposite sides of flange 119 for the same purpose.

Figure 3:
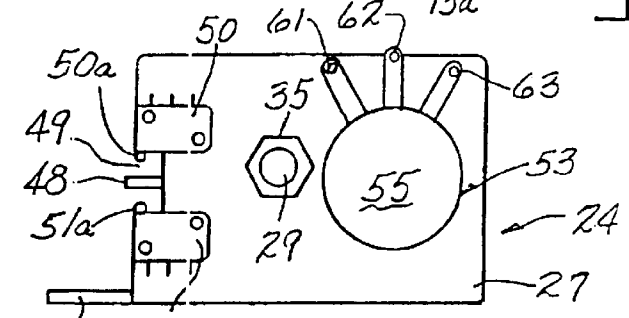
FIG. 3 is a side elevation of a support member within the base member seen in the plane of lines 3—3 of FIG. 2.

Shaft 113 is journaled in side walls 114 and 115*a* and is connected to treadle member, as hereinafter described, and will rotate when treadle member 112 is depressed. A support member 124 having a base portion 125 joining spaced apart upstanding side walls 126 and 127 is secured to base member 111 as by a plurality of screws 128. Support member 124 may be a stamping with the side walls 126 and 127 later bent upwardly. Side wall 126 is of lesser height than side wall 127 and has an upstanding portion 126*a* which mounts one or more switches 150 in a manner similar to switches 50 and 51, as shown in FIG. 3.

Mounted between side walls 126 and 127 of support member 124 is an operating arm 136 having a long leg 137 and a short leg 138.

The short leg 138 of operating arm 136 has a finger 148 extending substantially perpendicular to leg 138. Finger 148 is arranged to close and/or open one or both of switches 150 dependent on the circuit design the invention is to be used with. This arrangement is similar to arm 48 in relation to switches 50 and 51 as shown in FIG. 3. It is to be understood that the use of one or two switches 150 is an option.

Operating arm 136 is fast on shaft 113. It is secured to shaft 113 in the same manner as arm 36 is shown secured to shaft 13 in FIG. 4. A pair of friction clamps 170 have extending arms 171 and 172 arranged to receive a bolt 173 extending into a ledge 174 in base member 112. Bolt 173 provides a means to adjust the force necessary to rotate shaft 113. The restraining force on shaft 113 is adjusted depending on the clamping force of friction clamps 170 on shaft 113. The clamping force is selected to be of a magnitude such that shaft 113 will only rotate when sufficient force is applied to treadle 112. Otherwise stated, treadle 112 will remain in a given position of depression once set there until reset by foot pressure.

Long leg 137 of operating arm 136 has a plate 137*a* bent substantially perpendicular therefrom which provides an elongated end surface 137*b*, the same as surface 37*b* of FIGS. 5*a* and 5*b*. Surface 137*b* is formed on an arc having a radius essentially the distance to the centerline of shaft 113. Plate 137*a* at its upper and lower edges has notches forming guide ways the same as 58 and 59, as shown in FIGS. 5*a* and 5*b*, defined therein for a cord as hereinafter pointed out.

An electrical element, shown as a potentiometer 160, is secured to side wall 127 of support member 125. Potentiometer 160 has the usual terminal connections as shown at 61–63 in FIG. 3, and a threaded stud 164 extending therefrom and through an opening in side wall 127. A nut 165 is received on stud 164 to clamp potentiometer 160 to side wall 127. A rotatable shaft 166 extends coaxially through stud 164.

Shaft 166 moves the wiper contact of potentiometer 160 over the range of the potentiometer resistance and typically will rotate through about 310 degrees.

The operation of the potentiometer 160 is the same as that previously disclosed in conjunction with FIGS. 1–6. A cord 167 is utilized to rotate shaft 166. Cord 167 has a first end attached to spring 168, which is attached to short leg 138 of operating arm 136. Cord 167 extends from spring 168 through guide way 58 (FIGS. 5*a* and 5*b*) over surface 137*b*, is spirally wrapped around shaft 166 a predetermined number of times, and is anchored at its other end in a slot defined in leg 137 of operating arm 136 as by forming a knot in the end at a lower as exemplified by the knot 67*a* in FIG. 4. Spring 168 serves to tension cord 167 and maintain tension therein as it may stretch with use over time.

The number of wraps of cord 167 about shaft 166 is chosen to provide sufficient frictional engagement with the wraps of cord and the potentiometer shaft to uniformly rotate potentiometer shaft 166 as a function of angular movement of operating arm 136. Cord 167 and spring 168 are of a fixed overall length. A sleeve bushing 169 is disposed about cord 167 where it passes over the end plate 137*a* of arm 136 to prevent wear on the cord.

Figure 6:
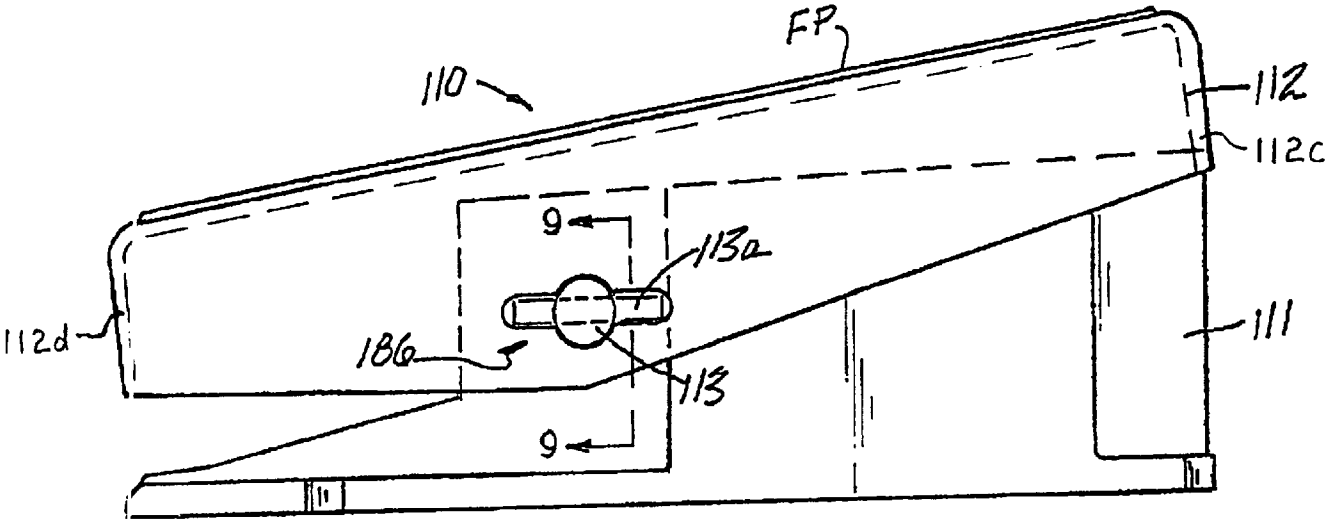
FIG. 6 is a view similar to FIG. 1 showing a side elevation of another embodiment of the invention with a treadle member pivotally mounted to a base member.
Figure 8:
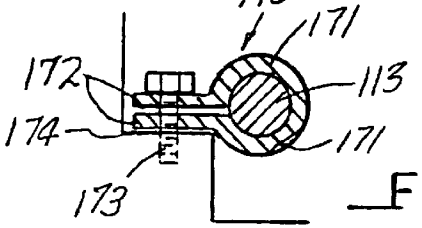
FIG. 8 is a sectional view seen in the plane of lines 8—8 of FIG. 8.

Reference is now made to FIG. 8 taken in conjunction with FIG. 6. Shaft 113 should remain in a predetermined angular position for a given position of the movable contact of potentiometer 160. A pair of friction brakes 170 is disposed about shaft 113. The brakes 170 comprise an annular portion 171 having extending arms 172. Annular portion 171 substantially surrounds shaft 113 and is in frictional contact therewith. Extending arms 172 receive a bolt 173 therethrough which is treaded into a ledge 174 defined on base member 111. As bolts 173 are treaded into base 111, they compress arms 172 and increase the frictional holding engagement of brakes 170 on shaft 113. Thus, when treadle member 112 is depressed under foot pressure to achieve a desired setting of potentiometer 160, that setting will be maintained in the absence further foot pressure to increase or decrease the effective resistance of potentiometer 160. A pair of washer-like bearings 174 are disposed between each of brakes 170 and operating arm 136. Operating arm 137 is made fast to shaft 113 in the same manner as shown in FIG. 4.

In view of the friction placed on shaft 113, a new and improved hinging arrangement is provided for pivotally connecting treadle member to shaft 113. Shaft 113 receives pins 113*a* therethrough at each end thereof, as shown in FIG. 7.

Figure 9:
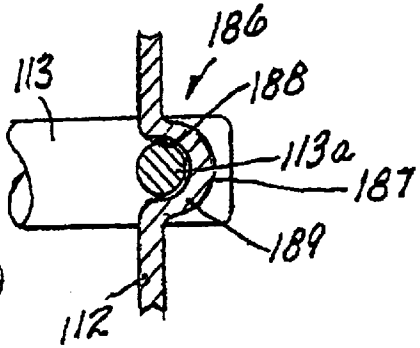
FIG. 9 is a view seen in the plane of lines 9—9 of FIG. 6.

Each side of treadle member 112 has a channel section 186 formed therein. Reference is now made to FIGS. 6 and 9. Each side of treadle member has an interrupted channel 187 formed thereon to receive a pin 113*a* extending through an end of shaft 113 shaft. When treadle member 112 is pivoted under foot pressure, the inner walls 188 and 189 of channel 187 will contact the pins 113*a* extending from either side of the ends of shaft 113 and rotate shaft 113 against the frictional forces exerted by brakes 170. This arrangement places coupled forces for rotating shaft 113 on a longer torque arm as compared to shaft sections 13*b* and 13*c* as shown in FIG. 2, resulting in lesser stress on shaft 113.

The embodiments of the invention disclosed thus far are arranged for the treadle to be maintained in a position in which it is set by foot pressure and thus the position of the wiper arm of potentiometer 60 will remain in a set position. It is within the scope of the invention to have a quick return of the treadle to a reference position when foot pressure is removed from the treadle member. The brake members 170 (FIGS. 7 and 8) may replaced by torsion springs (not shown) anchored at one end beneath bolts 173 and at the other end to the side walls of support member 124. The embodiment of FIGS. 1–5 may be arranged in the same manner with the deletion of compression springs 34 and 35 and friction pads 42 and 43.

The invention provides for smooth, non-incremental, rotation of the shaft of an electrical element with applied foot pressure and provides mechanism for such operation in a simplified and economical structure. The invention further provides a simplified and rugged hinge construction for apparatus of the type described.

It may thus be seen that the objects of the invention set forth above as well as those made apparent are efficiently attained. While preferred embodiments of the invention have been set forth for purposes of disclosure, modifications to the disclosed embodiments as well as other embodiments of the invention may occur to those skilled in the art. Accordingly, the appended claims are intended to cover all modifications to the disclosed embodiments of the invention as well as other embodiments thereof which do not depart from the spirit and scope of the invention.

What is claimed is:

1. An apparatus for a foot operated mechanism comprising:

a base member having side walls defining a top opening cavity, a first shaft rotatably mounted in said side walls of said base member, a treadle member having treadle member side walls, an electrical element having a rotatable operating shaft secured to said base member in said cavity, an operating arm having a first end and a free end, said operating arm mounted to said first shaft at said first end, said free end extends toward said electrical element operating shaft, said free end including a surface defined between upper and lower edges, a cord of predetermined length connected to said operating arm and extending over said surface, said cord spirally wrapped a plurality of times about said electrical element operating shaft, and a spring connected to said cord and said operating arm.

2. The apparatus of claim 1 further comprising an aperture defined in said surface, said aperture is adjacent the lower edge of said surface, an end of said cord extends through said aperture and is anchored to said operating arm.

3. The apparatus of claim 1 wherein the cord is a flexible cord.

4. The apparatus of claim 1 wherein said operating arm has a long leg and a short leg, said surface being defined on said long leg at the free end thereof substantially perpendicular to said long leg, a guide way for said cord defined on said upper edge.

5. The apparatus of claim 4, wherein said cord has a first end connected to said short leg and a second end connected to said long leg.

6. The apparatus of claim 1, wherein said surface is curved.

7. The apparatus of claim 1, further comprising means for stopping said operating arm.

8. The apparatus of claim 1, further comprising means for stopping said first shaft.

9. An apparatus for a foot operated mechanism comprising:

a base member having side walls defining a top opening cavity, a first shaft rotatably mounted in said side walls of said base member, a treadle member mounted to said first shaft and arranged to rotate said first shaft when depressed by foot pressure, an electrical element having a rotatable operating shaft secured to said base member in said cavity, an operating arm having a first end and a free end, said operating arm mounted to said first shaft at said first end, said free end extends toward said electrical element operating shaft, said free end including a surface defined between upper and lower edges, a cord of predetermined length connected to said operating arm and extending over said surface, said cord spirally wrapped a plurality of times about said electrical element operating shaft, wherein said treadle member has a top foot engaging portion and side walls depending there from, said treadle member side walls having channels defined therein with walls extending outwardly from said treadle member side walls, openings defined through said channels intermediate the ends thereof for the ends of said first shaft, said ends of said first shaft receiving a pin there through of a length sufficient to engage the walls extending outwardly from said treadle member side walls and defining said channels on either side of said first shaft.

10. An apparatus for a foot operated mechanism comprising:

a base member having side walls defining a top opening cavity, a first shaft rotatably mounted in said side walls of said base member, a treadle member mounted to said first shaft and arranged to rotate said first shaft when depressed by foot pressure, an electrical element having a rotatable operating shaft secured to said base member in said cavity, an operating arm having a first end and a free end, said operating arm mounted to said first shaft at said first end, said free end extends toward said electrical element operating shaft, said free end including a surface defined between upper and lower edges, a cord of predetermined length connected to said operating arm and extending over said surface, said cord spirally wrapped a plurality of times about said electrical element operating shaft, wherein said operating arm has a long leg and a short leg, said surface being defined on said long leg at the free end thereof substantially perpendicular to said long leg, a guide way for said cord defined on said upper edge, an end of said cord being connected to said short leg.

11. An apparatus for a foot operated mechanism comprising:

a base member having side walls defining a top opening cavity, a first shaft rotatably mounted in said side walls of said base member, a treadle member having treadle member side walls, an electrical element having a rotatable operating shaft secured to said base member in said cavity, an operating arm having a first end and a free end, said operating arm mounted to said first shaft at said first end, said free end extends toward said electrical element operating shaft, said free end including a surface defined between upper and lower edges, a cord of predetermined length connected to said operating arm and extending over said surface, said cord spirally wrapped a plurality of times about said electrical element operating shaft, and an aperture adjacent the lower edge of said surface and an end of said cord is anchored at said aperture.

12. An apparatus for a foot operated mechanism comprising:

a base member having side walls defining a top opening cavity, a first shaft rotatably mounted in said side walls of said base member, a treadle member mounted to said first shaft and arranged to rotate said first shaft when depressed by foot pressure, an electrical element having a rotatable operating shaft secured to said base member in said cavity, an operating arm having a first end and a free end, said operating arm mounted to said first shaft at said first end, said free end extends toward said electrical element operating shaft, said free end including a surface defined between upper and lower edges, a cord of predetermined length connected to said operating arm and extending over said surface, said cord spirally wrapped a plurality of times about said electrical element operating shaft, wherein said first shaft is frictionally engaged by braking means secured to said base member, said braking means determining the foot pressure necessary to rotate said first shaft and acting to hold said first shaft in a position determined by applied foot pressure on said treadle member.

13. An apparatus for a foot operated mechanism comprising:

a base member having side walls containing an electrical element, a shaft journaled in said side walls, a treadle member having a top foot engaging portion and side walls depending from said top portion, said treadle member side walls having channels defined therein with walls extending outwardly from said treadle member side walls, openings for the ends of said shaft defined intermediate the ends of said channels, said each end of said shaft receiving a pin therethrough of a length sufficient to engage the walls extending outwardly from said treadle member side walls and defining said channels on either side of said shaft.

* * * * *